US011174134B2

(12) United States Patent
Strähle

(10) Patent No.: US 11,174,134 B2
(45) Date of Patent: Nov. 16, 2021

(54) APPARATUS FOR COMPENSATING DIAGONAL PULL IN CRANES

(71) Applicant: LIEBHERR-WERK BIBERACH GMBH, Biberach an der Riß (DE)

(72) Inventor: Alexander Strähle, Langenau (DE)

(73) Assignee: Liebherr-Werk Biberach GmbH, Biberach an der Riß (DE)

( * ) Notice: Subject to any disclaimer, the term of this patent is extended or adjusted under 35 U.S.C. 154(b) by 133 days.

(21) Appl. No.: 16/348,321

(22) PCT Filed: Nov. 9, 2017

(86) PCT No.: PCT/EP2017/001305
§ 371 (c)(1),
(2) Date: May 8, 2019

(87) PCT Pub. No.: WO2018/086740
PCT Pub. Date: May 17, 2018

(65) Prior Publication Data

US 2020/0180917 A1 Jun. 11, 2020

(30) Foreign Application Priority Data

Nov. 9, 2016 (DE) ..... 10 2016 013 320.1
Nov. 3, 2017 (DE) ..... 10 2017 125 715.2

(51) Int. Cl.
*B66C 13/48* (2006.01)
*B66C 13/16* (2006.01)
(Continued)

(52) U.S. Cl.
CPC ..... *B66C 13/48* (2013.01); *B66C 13/16* (2013.01); *B66C 13/20* (2013.01); *B66C 13/46* (2013.01);
(Continued)

(58) Field of Classification Search
CPC ..... B66C 13/066; B66C 13/08; B66C 13/16; B66C 13/18; B66C 13/20; B66C 13/30;
(Continued)

(56) References Cited

U.S. PATENT DOCUMENTS 7,489,098 B2 2/2009 Harris et al.
2013/0253759 A1* 9/2013 Matsumoto ..... B66C 13/16 701/31.1
2016/0052753 A1* 2/2016 Willim ..... B66C 13/22 212/276

FOREIGN PATENT DOCUMENTS

CN 101920914 A 12/2010
DE 44 09 153 A1 9/1995
(Continued)

OTHER PUBLICATIONS

Machine Translation for JP 2000191277A (Year: 2000).*
Machine Translation for JP 2005306602A (Year: 2005).*

*Primary Examiner* — Michael R Mansen
*Assistant Examiner* — Juan J Campos, Jr.
(74) *Attorney, Agent, or Firm* — Dilworth & Barrese, LLP

(57) ABSTRACT

The invention relates to an apparatus for compensating diagonal pull in cranes having at least one boom, having a boom drive for adjusting an angle and/or a length of the boom and/or for traveling a trolley, and having a control/regulation apparatus for controlling/regulating the boom drive. The invention is further directed to a crane having a corresponding apparatus.

9 Claims, 7 Drawing Sheets

(51) Int. Cl.

| | |
|---|---|
| ***B66C 23/16*** | (2006.01) |
| ***B66C 13/20*** | (2006.01) |
| ***B66C 23/00*** | (2006.01) |
| ***B66C 23/88*** | (2006.01) |
| ***B66C 13/46*** | (2006.01) |
| *B66C 23/42* | (2006.01) |

(52) U.S. Cl.
CPC ..... *B66C 23/54* (2013.01); *B66C 23/88* (2013.01); *B66C 23/16* (2013.01); *B66C 23/42* (2013.01)

(58) Field of Classification Search
CPC ..... B66C 13/46; B66C 13/48; B66C 23/16; B66C 23/42; B66C 23/54; B66C 23/88; B66C 23/905
See application file for complete search history.

(56) References Cited

FOREIGN PATENT DOCUMENTS

| | | | | | |
|---|---|---|---|---|---|
| DE | 198 42 436 | A1 | | 3/2000 | |
| DE | 10 2007 039 408 | A1 | | 11/2008 | |
| EP | 2550226 | B1 | | 1/2013 | |
| JP | H01-167199 | A | | 6/1989 | |
| JP | H01-256496 | A | | 10/1989 | |
| JP | H01-256497 | A | | 10/1989 | |
| JP | 2000191277 | A | * | 7/2000 | ..... B66C 13/20 |
| JP | 2005306602 | A | * | 11/2005 | ..... B66C 13/08 |

* cited by examiner

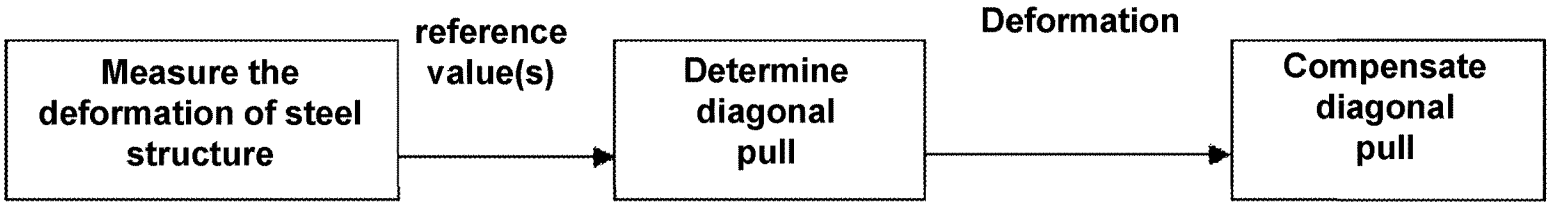
FIG. 3
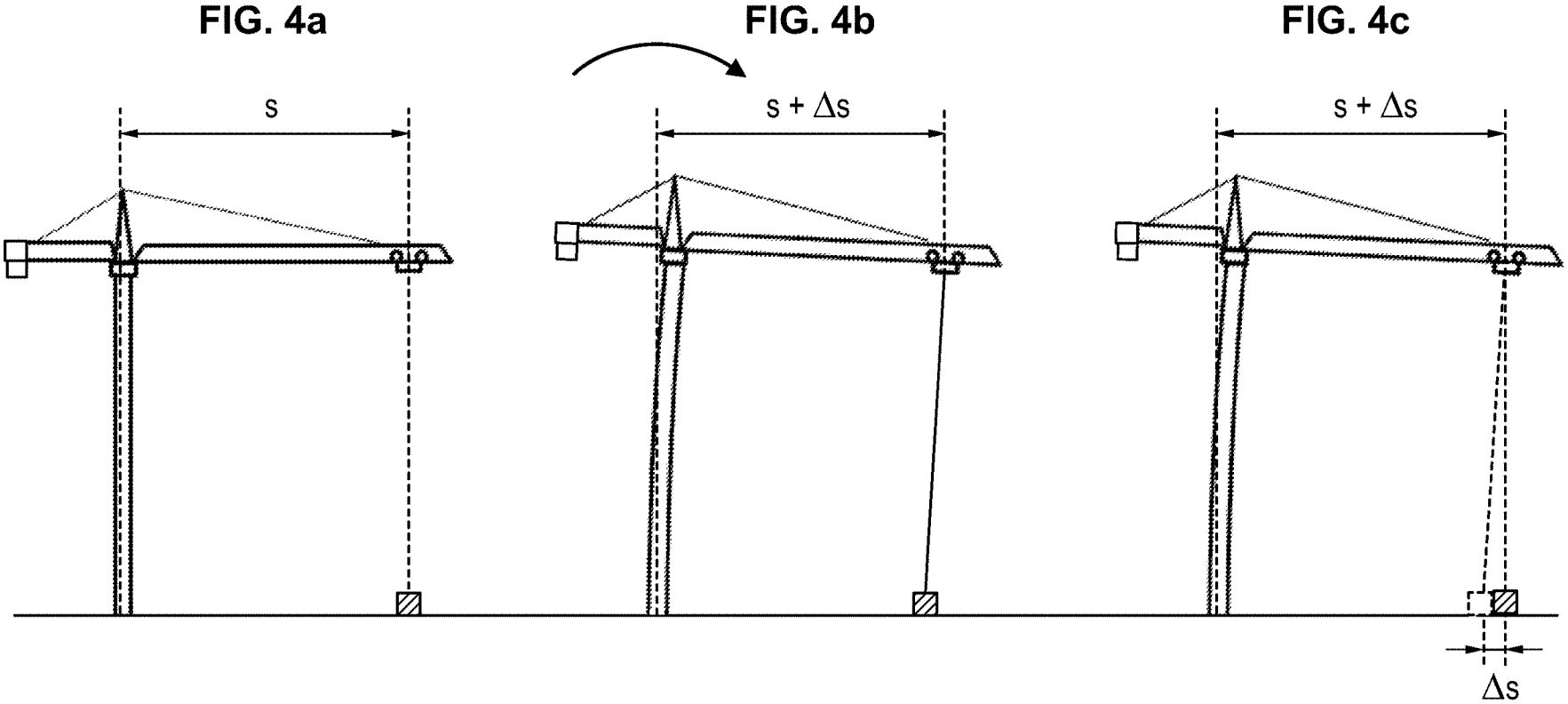
FIG. 4a
FIG. 4b
FIG. 4c

APPARATUS FOR COMPENSATING DIAGONAL PULL IN CRANES

BACKGROUND OF THE INVENTION

The invention relates to an apparatus for compensating diagonal pull in cranes having at least one boom, having a boom drive for adjusting an angle and/or a length of the boom and/or for traveling a trolley, and having a control/regulation apparatus for controlling/regulating the boom drive.

It is known in accordance with the prior art that a deformation of the geometry or of the steel construction of a crane occurs on the lifting of loads by means of the crane due to the load on the tower and/or on the boom guying. This deformation results in a diagonal pull of the rope or of the load rope of the crane. If the load is now raised from the ground or in that moment in which the load hardly touches the ground or does not touch it at all, an oscillating movement of the now freely suspended or raised load occurs due to the previously produced diagonal pull of the rope. A relaxation of the steel construction or the crane on the placing down of a load can equally have the result that the crane rebounds and that thus a diagonal pull of the rope is again effected. This is accompanied by possible dangers such as the creation of a load oscillation, which can in particular result in material damage or in injuries to humans such as crushing in tight spaces. The horizontal movement of the load can furthermore have the result that the permitted load torque of the crane is exceeded.

As is known, experienced crane operators compensate the diagonal pull by a direct correction of the outreach such as by traveling a trolley with trolley boom cranes or by adjusting the boom angle with luffing boom cranes. The angle change due to the load can thus be detected in luffing boom cranes in which typically an inclinometer is installed in the boom. The crane operator thus has the possibility of correcting the boom angle to the original value before load rises from the ground. However, this does not take place automatically, that is, the crane operator has control two drives in parallel to raise a load. In addition, in this process, only the angle of bend of the tower and the boom is compensated, but not the deflection of the tower or a horizontal path or a deviation from the horizontal of the upper crane as a result of the tower bending. As a rule there is no possibility of detecting the deformation with trolley boom cranes.

SUMMARY OF THE INVENTION

Against this background, it is the object of the invention to provide an apparatus by means of which the compensation of the diagonal pull in cranes can be improved or simplified.

This object is satisfied in accordance with the invention by an apparatus for compensating diagonal pull in cranes having the features herein. Advantageous embodiments are the subject of the dependent claims. An apparatus is accordingly provided having at least one boom, a boom drive for adjusting an angle and/or a length of the boom and/or for traveling a trolley, a sensor for detecting the angle of the boom and/or of the deformation of at least one part of the crane, and a control/regulation apparatus for controlling the boom drive, wherein the detected sensor value on the raising and/or placing down of a load by the crane is held constant by means of the control/regulation apparatus and of the boom drive.

The boom drive can, for example, be a motor winch for changing the guying of the crane or the positon of the trolley and/or a hydraulic cylinder piston apparatus by means of which the boom can be pivoted.

The apparatus in accordance with the invention can thus also be used with a mobile crane or can be coupled thereto and can be used accordingly for reducing or prevent diagonal pull in mobile cranes.

An angle of the boom that is spanned by the boom and by the horizontal can be meant by the detected sensor value. Alternatively, the sensor value can be a value that is proportional to a deformation of the crane and corresponds, for example, to a strain in the crane construction. It is meant by the keeping constant of the sensor value that the control/regulation apparatus detects a first actual value by means of the sensor and controls/regulates the boom drive on the change of the first-measured actual value subsequently detected such that the error or the change or deviation between a first-measured actual value and a subsequently measured deviating value is minimized. The deformation of the crane can, for example, be the bending of the tower or of the boom of the crane. A diagonal pull compensation can thus advantageously be carried out in accordance with the invention by sensors provided in known cranes.

It is conceivable in a preferred embodiment that the boom drive is a retraction winch or a guying winch. The corresponding winch can thus be controlled or regulated to move the boom via the control/regulation apparatus such that the sensor value or parameter detected by the sensor becomes constant or a deviation between a first-measured sensor value and a value measured in the further operation of the crane is reduced or minimized. It is conceivable here that the retraction winch or the guying winch is used to change the length of the boom of the crane by a corresponding retraction or extension of the boom. The diagonal pull can hereby likewise be reduced; however, it cannot be completely compensated since the deflection of the tower or of the boom is not compensated. Alternatively, it is also conceivable that the boom drive is configured as a cylinder piston apparatus and is coupled to the boom to pivot it.

It is conceivable in a further preferred embodiment that the at least one sensor is an inclinometer, an optical sensor, a length sensor for measuring deformations, a GPS sensor and/or a diagonal pull sensor in or at a guying of the crane. A use of more than one sensor for detecting the respective crane parameters or the geometrical configuration or deformation of the crane can accordingly be utilized. It is in particular possible to use more than one sensor for detecting the orientation or the deformation of the crane in a combined manner.

It is conceivable in a further preferred embodiment that the control/regulation apparatus controls the boom drive on the basis of a reference vale calculated from a plurality of sensor values. The calculated reference value can, for example, be the load torque that can be derived from the weight of the load raised by the crane and from the corresponding outreach or from the support forces and the outreach acting on the crane.

It is conceivable in a further preferred embodiment that the ratio of sensor value and/or reference value to the outreach displacement due to the deformation of the crane is scaled or determined using a test weight and/or is determined by calculation. The stiffness and the crane structure or the geometry of the crane can be used for a determination by calculation of the ratio of the sensor value or reference value to the outreach displacement. The invention is further directed to a crane having an apparatus in accordance with the description herein.

BRIEF DESCRIPTION OF THE DRAWINGS

Further details and advantages of the invention are explained with reference to the embodiment shown by way of example in the Figures. There are shown:

FIG. 3: effective structure on the use of a crane with an apparatus in accordance with the invention;

FIGS. 4*a*-4*c*: crane while raising a load;

DESCRIPTION OF THE PREFERRED EMBODIMENTS

Figure 1A:
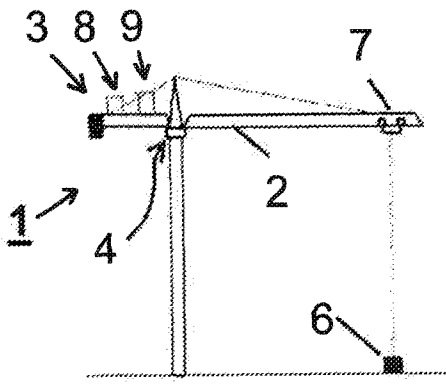
PRIOR ART Fig. 1a
FIG. 1*a*: a prior art crane of the category with a load lying on the ground.

FIG. 1*a* shows a crane 1 known from the prior art having a boom 2 that does not have an apparatus in accordance with the invention for compensating diagonal pull. The crane 1 comprises a boom drive 3 that can adjust the boom 2 and/or that can move the trolley 7. With a load 6 placed on the ground, the crane 1 is at least not loaded by the load 6 and therefore also does not have any deformations caused by the load.

The term of the boom drive 3 can also mean a drive for moving the boom 2 or also any other drive provided at the crane such as a retraction winch 8 or a guying winch 9 by means of which further or different crane components can be moved.

On raising the load 7 from the ground, the crane 1 is also correspondingly loaded, even while the load initially still remains on the ground or contacts the ground. This inter alia has the result of a horizontal movement of the upper crane or in particular of the boom 2 and of a corresponding diagonal pull of the rope, as FIG. 1*b* shows.

Figure 1B:
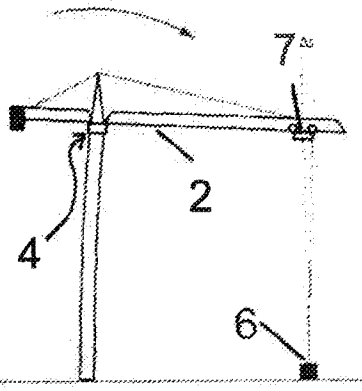
PRIOR ART Fig. 1b
FIG. 1*b*: a prior art crane of the category just before the raising of a load.
Figure 1C:
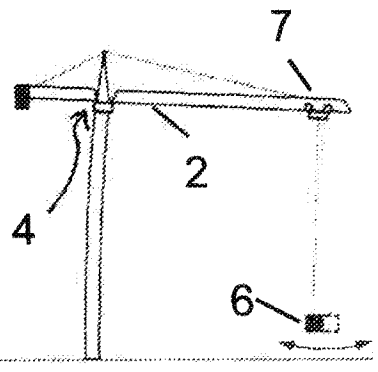
PRIOR ART Fig. 1c
FIG. 1*c*: a prior art crane of the category just after the raising of a load.

If the load 6 rises from the ground, as shown in FIG. 1*c*, a diagonal position or a diagonal pull of the rope of the crane 1 results due to the horizontal movement or slewing movement of the upper crane at the time of the raising of the load 6 previously shown in FIG. 1*b*, which can result in load oscillation and accordingly in an outreach increase due to the load oscillation.

Figure 2A:
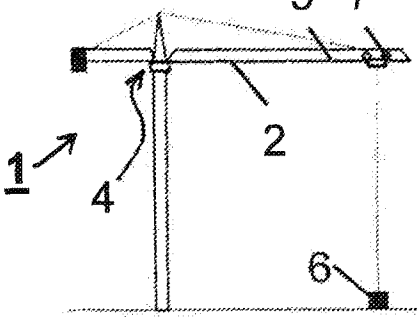
FIG. 2*a*: a crane with an apparatus in accordance with the invention for compensating diagonal pull with a load on the ground.

The crane 1 shown in FIG. 2*a* and having an apparatus in accordance with the invention for compensating the diagonal pull initially hardly differs from the crane 1 shown in FIG. 1*a* from the prior art, with respective cranes being shown in n unloaded state in FIGS. 1*a* and 2*a*. If, however, the crane 1 in accordance with the invention in accordance with FIG. 2*b* starts to raise the load 6 while the load is still on the ground or is still in contact with the ground, the outreach of the crane 1 can be automatically reduced in accordance with the invention, whereby the diagonal pull is correspondingly reduced and an oscillation movement on a further raising of the load 6 is prevented. If the crane 1 raises the load from the ground as shown in FIG. 2*c*, no diagonal pull is present in accordance with the invention at that time and no load oscillation arises. For this purpose, as shown in FIG. 2*b*, the trolley 7 is traveled and/or the boom 2 is pivoted such that the rope has no diagonal pull or is vertically arranged.

Figure 2B:
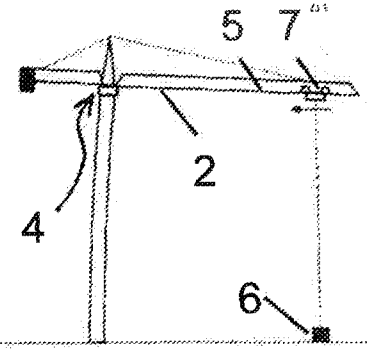
FIG. 2*b*: a crane with an apparatus in accordance with the invention for compensating diagonal pull just before the raising of a load.
Figure 2C:
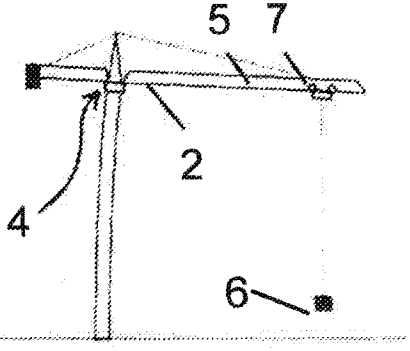
FIG. 2*c*: a crane with an apparatus in accordance with the invention for compensating diagonal pull just after the raising of a load.

The inclination of the boom 2, the deformation on the basis of a detected length change of the boom 2 and/or the strain in the guying of the crane 1 can, for example, be detected by means of the sensor 5 shown in FIGS. 2*a* to 2*c*.

At least one corresponding sensor 5 can, for example, be provided at the boom 2 or can alternatively or additionally thereto be provided at further components such as at the tower of the crane. The control/regulation apparatus 4 can detect the values detected by the sensor 5 or by the sensors 5 and can determine on their basis how the boom drive 3 is to be controlled so that no diagonal pull arises where possible.

To accordingly set the control/regulation apparatus 4, that can, for example, be formed as part of the crane 1, to control the boom drive 3, a known test weight can be raised by means of the crane 1, with the detected sensor values being able to be correspondingly stored. This can be carried out at different boom angles or outreaches of the crane 1. A correspondingly prepared value table having the detected sensor values, the test weight and/or the corresponding boom angles or outreaches can be used to compensate the diagonal pull in operation of the crane 1.

FIG. 3 shows a schematic representation of the effective structure on the use of a crane 1 having an apparatus in accordance with the invention. In this respect, one or more reference values are first determined that are in a clear relationship with the deformation of the crane 1 or of the steel structure of the crane 1. A value that is in particular calculated can equally be generated or detected by the interaction of two or more sensors 5. In this respect, the following sensors can be used in any desired combination and number: Load torque sensors; inclinometers in the tower and/or boom 2 of the crane 1; force sensors or a metering shaft or a tensile force sensor in the hoist rope line; outreach sensors; force sensors in the guying, in the guying rope, in the neck rope and/or in the retraction rope; GPS sensors; optical sensors such as a camera; force sensors and/or strain sensors and/or length sensors in the steel construction of the crane 1; force sensors and/or hydrostatic pressure sensors in the support of the crane 1; pressure sensors in an adjustment cylinder of the crane 1; and/or absolute encoders on a hoisting drum or winch.

The deformation of the crane 1 can be generated or determined from the determined reference value or from the determined reference values using a transfer function. The transfer function can be formed, for example, using a calculated connection or a map. The deformation can, for example, correspond to an outreach displacement and/or to an angle change of the tower and/or boom 2. Different crane configurations or tower/boom configurations or hoist rope reevings can be taken into account here depending on the crane type.

There are the following possibilities for the determination of the transfer function:

- the transfer function can be fixedly stored in a control or in the control/regulation apparatus 4. In the present case, the terms control and control/regulation apparatus 4 can be used as synonyms;
- the transfer function or the transfer functions can be determined once by the crane operator, for example by measurements and/or by calculations, and can then be fixedly stored in the control or in the control/regulation apparatus 4;
- the transfer function can be determined by reference measurements or by scaling. In one or more measurements, the reference value or the reference values and additionally the deformation can be measured to determine their relationship;
- the transfer function can be determined by a combination of calculation and the reference measurement. The relationship between the reference value and the outreach displacement can be stored in the crane control, but can additionally be checked and/or adapted by a reference measurement;
- the transfer function can be determined by its calculation in the control or in the control/regulation apparatus 4;
- the transfer function can be sent to the control or to the control/regulation apparatus 4, for example, via UMTS, LTE, 4G and/or 5G.

Finally, in accordance with the active principle shown, the now known deformation of the crane and thus the diagonal pull can be displayed and corrected or compensated;

- The deformation is only visualized, e.g. on a display, on the display of the deformation. The operator thus has the possibility of carrying out the correction himself, for example via a manual control device;
- On an automatic correction, the crane control compensates the outreach displacement fully automatically; This mode can either be permanently active or can be activated as required by the operator, e.g. via a selection switch and/or a display input; and
- the correction movement can also be controlled by the operator via a button or via a control lever and/or via a display input. The travel movement for compensating the diagonal pull is thus deliberately specified by the operator.

The deformation of the crane 1 can be measured, for example, while using a payload sensor and an outreach sensor.

In a first approach, the corresponding sensors 5 for measuring the payload and the outreach can be installed in the crane 1. The load torque that in this case represents the reference value is determined by calculation in the crane control from these two sensors 5. It is equally conceivable that the outreach is a second reference value in addition to the load torque. This substantially depends on the crane structure and on the static relationships caused thereby.

The diagonal pull can be determined by a reference measurement or by scaling. After the assembly of the crane 1, the relationship between the reference value "load torque" and the outreach displacement can be determined using a reference measurement. The outreach displacement can here correspond to the deformation of the steel construction of the crane 1. For this purpose, a known payload with a known outreach can be raised and the outreach increase resulting from the raising is measured. The outreach displacement Δs here results from the following equation:

$$\Delta s = s_{real} - s_{Outreach\ sensor}$$

FIGS. 4*a*-4*c* illustrate this relationship. FIG. 4*a* here shows a crane with a load placed on the ground, with the crane not being loaded by the load. FIG. 4*b* shows the crane in which the load to be raised by it is admittedly still on the ground, but a portion of its weight force already acts on the crane. A horizontal movement of the crane 1 or of the upper crane is effected in this state. FIG. 4*c* shows the crane of FIG. 4*b* at the moment of the raising of the load from the ground, with the measured outreach increase Δs being shown in FIGS. 4*b* and 4*c*.

Figure 5:
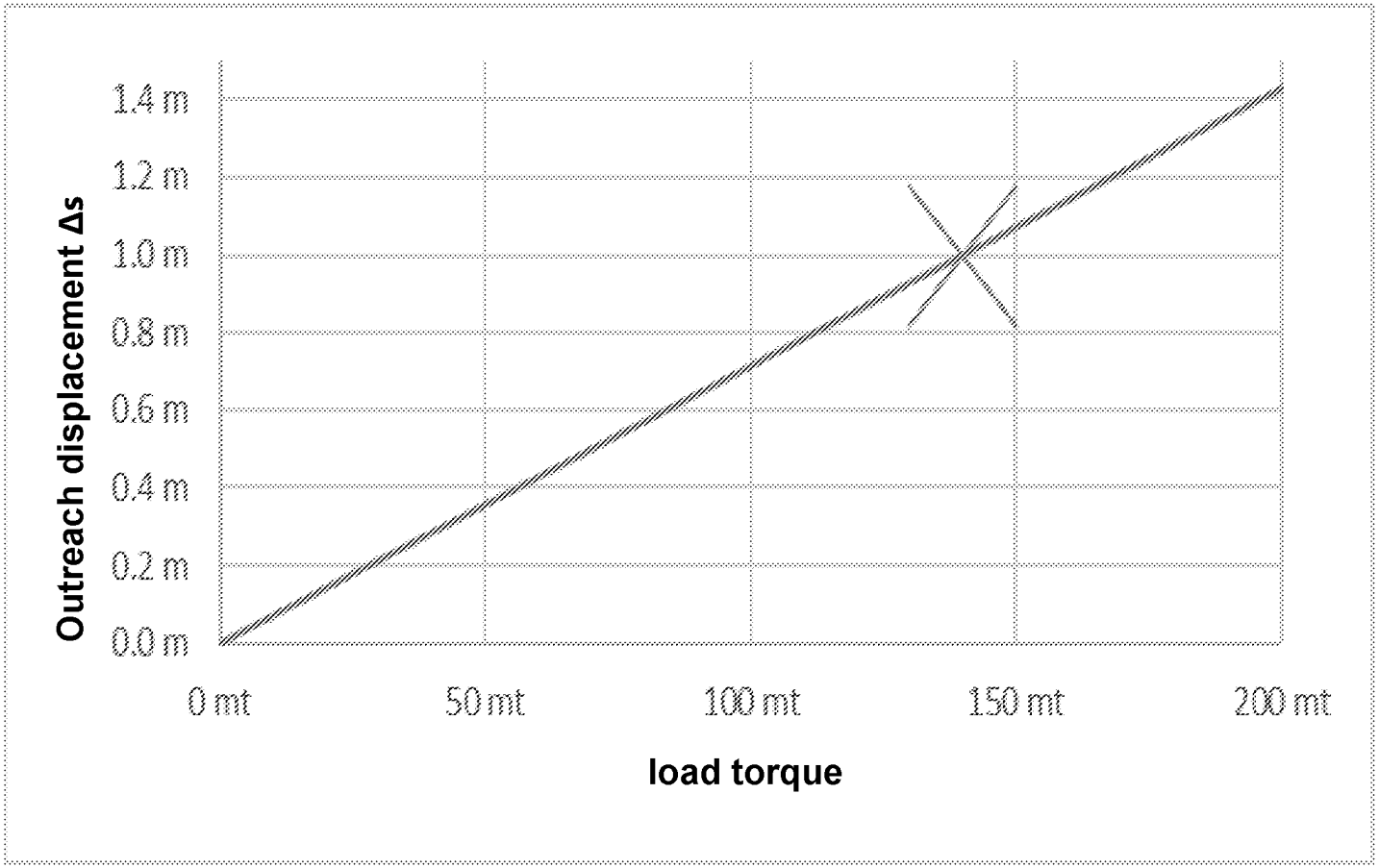
FIG. 5: characteristic of the load torque and of the outreach displacement of a crane.

In this example, a linear relationship between the load torque and the outreach displacement is assumed that is shown in FIG. 5. Non-linear relationships would equally be conceivable. The above-determined relationship is stored in the crane control 4.

The crane operator can activate the automatic correction of the diagonal pull at a display to compensate a unwanted diagonal pull. On a raising of a load, the load torque is calculated, in particular online, from the payload and from the outreach.

The outreach with the trolley 7 is here automatically corrected by the correspondingly determined outreach displacement.

$$s^* = s - s_{cor}$$

Figure 6:
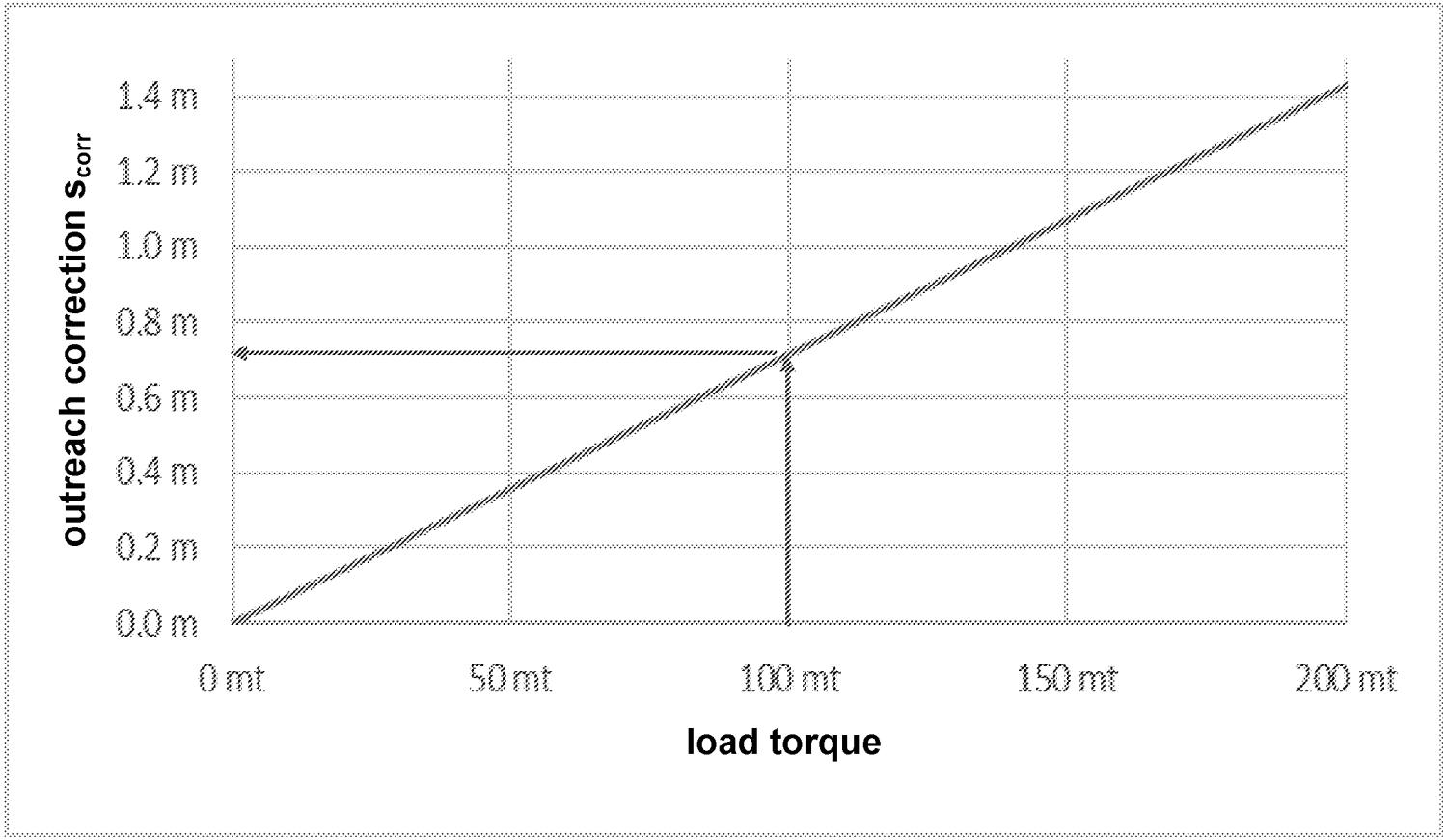
FIG. 6: characteristic of the load torque and of the outreach displacement of a crane with the time of the raising of a load.

Since the crane 1 is initially deformed before the raising of the load 6 and since this deformation is compensated simultaneously or with a time offset, there is no longer any diagonal pull at the time of the raising of the load 6 from the ground. This situation is shown in FIG. 6 and in FIGS. 2*a* to 2*c*.

If the invention is used in connection with a mobile crane having a luffing boom, a different active principle can also be considered. It is thus conceivable that the deformation of the steel construction is measured by inclinometers in the boom and by absolute value encoders of the guying winch 9. The diagonal pull can in this situation be determined by means of a transfer function that can be fixedly stored in the control. The compensation of the diagonal pull then takes place via corresponding correction commands.

Figure 7:
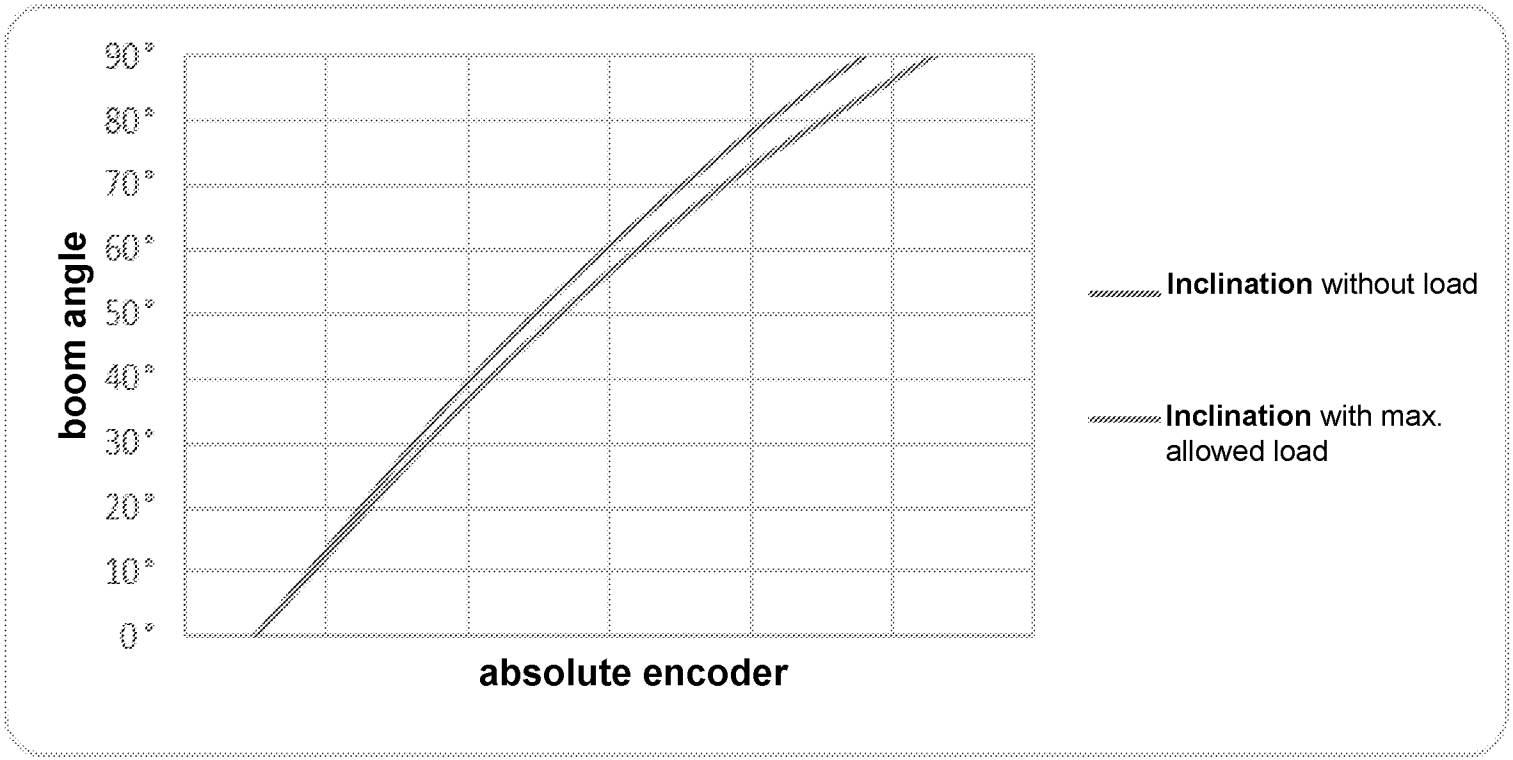
FIG. 7: characteristic of the output values of an absolute encoder and of the boom angle of a crane without a load and with a maximum permitted load.

In this case, the boom inclination in a mobile crane having a luffing boom is adjusted using the guying winch 9 that is designed with an absolute value encoder. There is a relationship between the values of the inclinometer in the boom and of the absolute encoder of the guying winch 9. On the attachment of a payload, the inclination of the boom changes due to the deformation of the steel construction of the tower and the boom and due to the stretching of the guying rope, the absolute encoder of the guying winch remains constant, in contrast. The relationship between the boom angle and the absolute encoder thereby changes. More details on this can be seen from FIG. 7.

Figure 8:
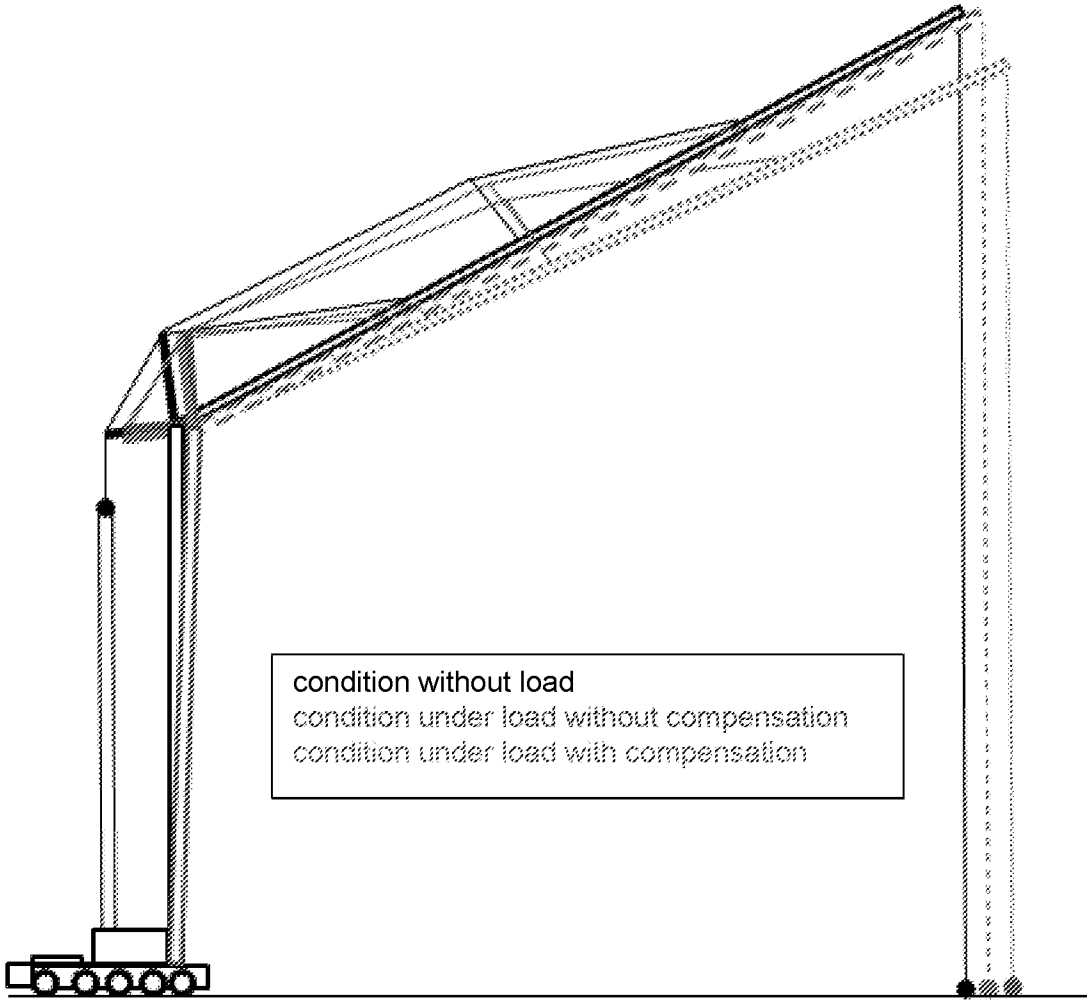
FIG. 8: a schematic view of a different boom inclination in accordance with a first approach.

The relationship between the measurement values of the inclinometer and of the absolute value encoder of the guying winch in the unloaded state (without payload) are fixedly stored in this example. An expected angle of inclination is thus associated with each value of the absolute encoder. On the raising of a payload, there is now a difference between the expected and the actual boom inclination. In the first approach, this difference can be corrected in that the boom angle is corrected to the original value again using the guying winch 9. In this respect, however, only the bending angle of the tower and of the boom is compensated, but not the deflection of the tower (horizontal path of the upper crane as a result of the tower bending). More details on this can be seen from FIG. 8.

Figure 9:
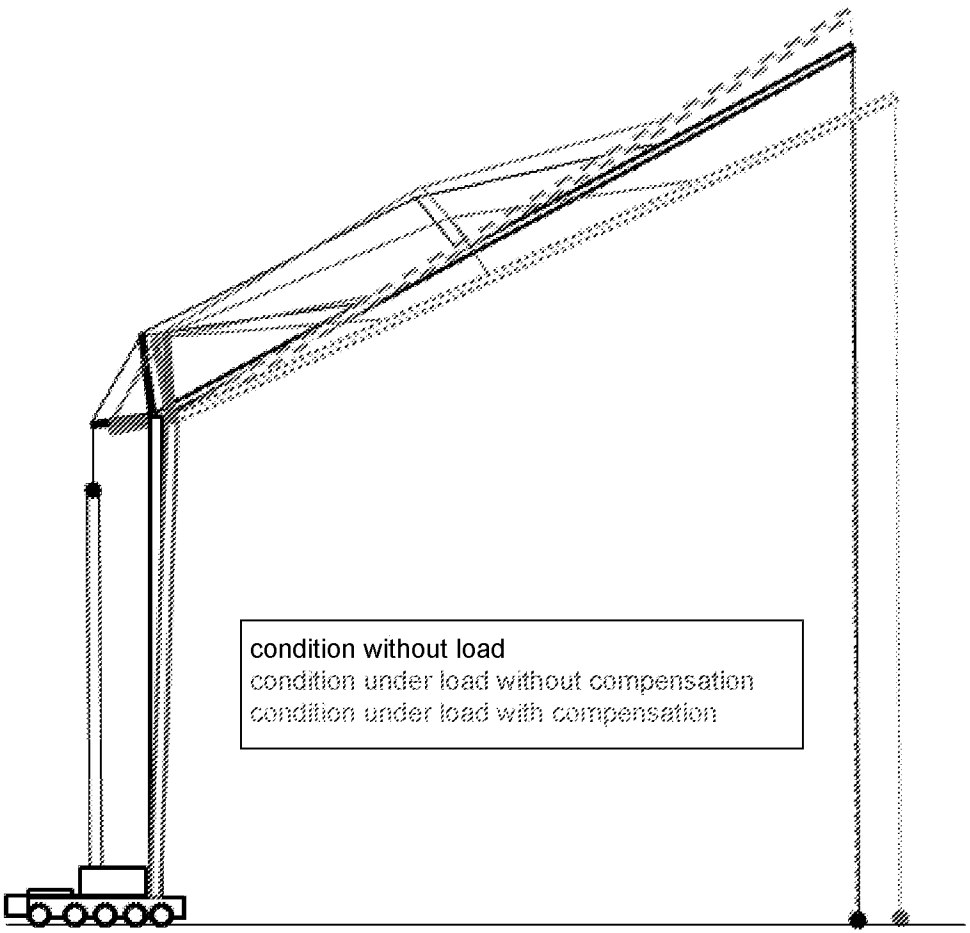
FIG. 9: a schematic view of a different boom inclination in accordance with a second approach.

In a second approach, the deflection of the tower can also be compensated in addition to the compensation of the angle. In this case, the boom angle has to be set more steeply than originally on a load. More details on this can be seen from FIG. 9.

The diagonal pull is visually presented to the crane operator at a display, possibly with an acoustic signal, to compensate the diagonal pull. The operator can trigger the correction movement or a correction command to adjust the boom by a button or by an input at the touch display.

The invention claimed is:

1. A tower crane, comprising a tower (1);

a boom (2) mounted on the tower (1) to extend outwardly therefrom;

a boom drive (3) arranged for adjusting an angle of the boom (2);

a sensor (5) arranged for detecting the angle of the boom (2); and a control/regulation apparatus (4) arranged for controlling the boom drive (3), wherein a detected sensor value is kept constant by the control/regulation apparatus (4) and the boom drive (3) on raising and/or placing down of a load (6) by the crane (1), the sensor (5) is one of an inclinometer, an optical sensor, a length sensor for measuring deformation, a GPS sensor or a hoist rope sensor in or at a guying of the crane (1), and the ratio of the sensor value or a reference value to outreach displacement due to the deformation of the crane (1), is scaled or determined using a test weight and/or determined by calculation.

2. The crane in accordance with claim 1, wherein the boom drive (3) is at least a retraction winch (8) or a guying winch (9).

3. The crane in accordance with claim 1, wherein the boom drive (3) is a hydraulic piston-cylinder apparatus.

4. The crane in accordance with claim 1, wherein the control/regulation apparatus (4) controls the boom drive (3) on the basis of a reference value calculated from a plurality of different sensor values.

5. A tower crane, comprising a tower (1);

a boom (2) mounted on the tower (1) to extend outwardly therefrom;

a trolley (7) slidably mounted along the boom (2);

a boom drive (3) arranged for traveling the trolley (7);

a sensor (5) arranged for detecting a deformation of at least a part of the crane (1); and a control/regulation apparatus (4) arranged for controlling the boom drive (3), wherein a detected sensor value is kept constant by the control/regulation apparatus (4) and the boom drive (3) on raising and/or placing down of a load (6) by the crane (1), the sensor (5) is one of an inclinometer, an optical sensor, a length sensor for measuring deformation, a GPS sensor or a hoist rope sensor in or at a guying of the crane (1), and the ratio of the sensor value or a reference value to outreach displacement due to the deformation of the crane (1), is scaled or determined using a test weight and/or determined by calculation.

6. The crane in accordance with claim 5, wherein the boom drive (3) is at least a retraction winch (8) or a guying winch (9).

7. The crane in accordance with claim 5, wherein the boom drive (3) is a hydraulic piston-cylinder apparatus.

8. The crane in accordance with claim 5, wherein the control/regulation apparatus (4) controls the boom drive (3) on the basis of a reference value calculated from a plurality of different sensor values.

9. The crane in accordance with claim 8, wherein the reference value is a load torque calculated from outreach of the crane (1) and weight of the load (6).

* * * * *